US006982678B2

(12) United States Patent
Obert et al.

(10) Patent No.: US 6,982,678 B2
(45) Date of Patent: Jan. 3, 2006

(54) APPARATUS AND METHOD USING WAVEFRONT PHASE MEASUREMENTS TO DETERMINE GEOMETRICAL RELATIONSHIPS

(75) Inventors: Thomas L. Obert, Pomona, CA (US); Kenneth W. Brown, Yucaipa, CA (US); Alan A. Rattray, Alta Loma, CA (US); John Gerstenberg, Lake Elsinore, CA (US); James R. Gallivan, Pomona, CA (US)

(73) Assignee: Raytheon Company, Waltham, MA (US)

( * ) Notice: Subject to any disclaimer, the term of this patent is extended or adjusted under 35 U.S.C. 154(b) by 96 days.

(21) Appl. No.: 10/817,400

(22) Filed: Apr. 2, 2004

(65) Prior Publication Data

US 2005/0219138 A1 Oct. 6, 2005

(51) Int. Cl.
*H01Q 13/00* (2006.01)

(52) U.S. Cl. ..... 343/775; 343/882

(58) Field of Classification Search ..... 343/772, 343/775, 840, 882
See application file for complete search history.

(56) References Cited

U.S. PATENT DOCUMENTS

| | | | | |
|---|---|---|---|---|
| 4,366,483 A | | 12/1982 | Hagedon et al. | 343/113 R |
| 4,524,359 A | | 6/1985 | Champagne | 343/16 M |
| 4,586,050 A | * | 4/1986 | Kuroda et al. | 342/426 |
| 5,457,464 A | * | 10/1995 | Scott et al. | 343/352 |
| 6,087,985 A | * | 7/2000 | Rummeli et al. | 342/359 |
| 6,252,558 B1 | | 6/2001 | Brown et al. | 343/781 R |
| 6,407,806 B2 | | 6/2002 | Fujisawa et al. | 356/139.03 |
| 6,611,236 B1 | * | 8/2003 | Nilsson | 343/757 |

OTHER PUBLICATIONS

Kai Chang, ed., Handbook of Microwave and Optical Components, Vol. 1, p. 153, John Wiley & Sons., Inc., 1989.
Merrill I. Skolnik, ed., Radar Handbook, second edition, pp. 3/36-3/37, McGraw Hill, 1990.

* cited by examiner

*Primary Examiner*—Shih-Chao Chen
(74) *Attorney, Agent, or Firm*—Thomas J. Finn; Leonard A. Alkov; Karl A. Vick

(57) ABSTRACT

An apparatus includes a microwave source that produces a microwave feed beam, and a first pair of microwave sensors that each intercept and receive a portion of the microwave feed beam. The two microwave sensors are spaced apart from each other along a first-pair axis. A first phase-comparison device has as it inputs the output signals of the two microwave sensors, and as an output a first phase comparison of the first-sensor output signal and the second-sensor output signal. A first geometrical calculator has as an input the first phase comparison and as an output a geometrical relationship of the first-pair axis to an other feature. This geometrical relationship output may be used to generate a control signal that is used to alter the geometrical relationship. There may be additional microwave sensors operating in a similar manner but spaced to provide information for other geometrical axes or allow improvements in geometrical measurements.

20 Claims, 7 Drawing Sheets

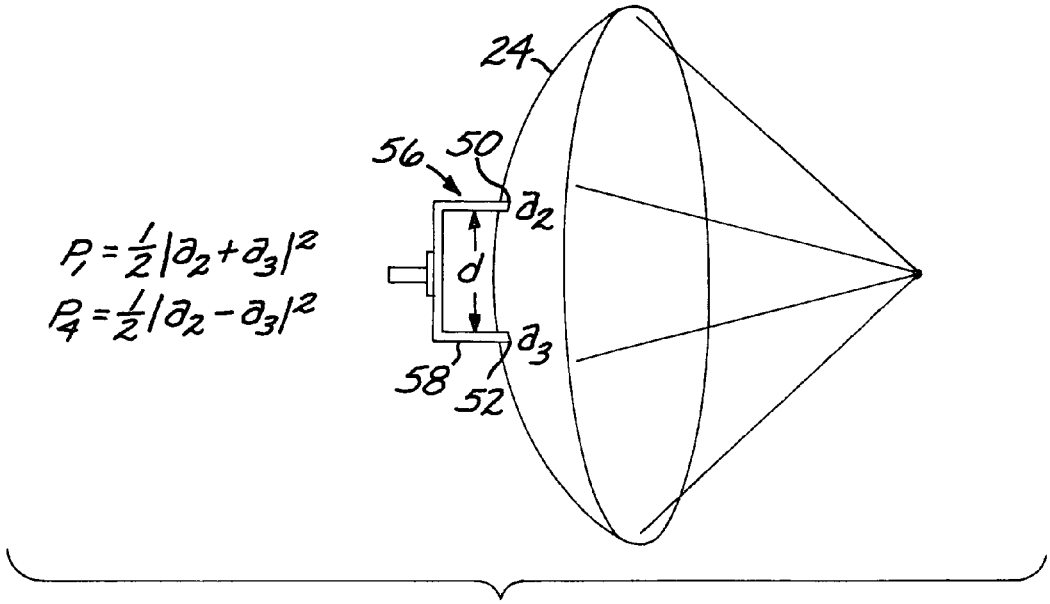
FIG. 5
FIG. 6
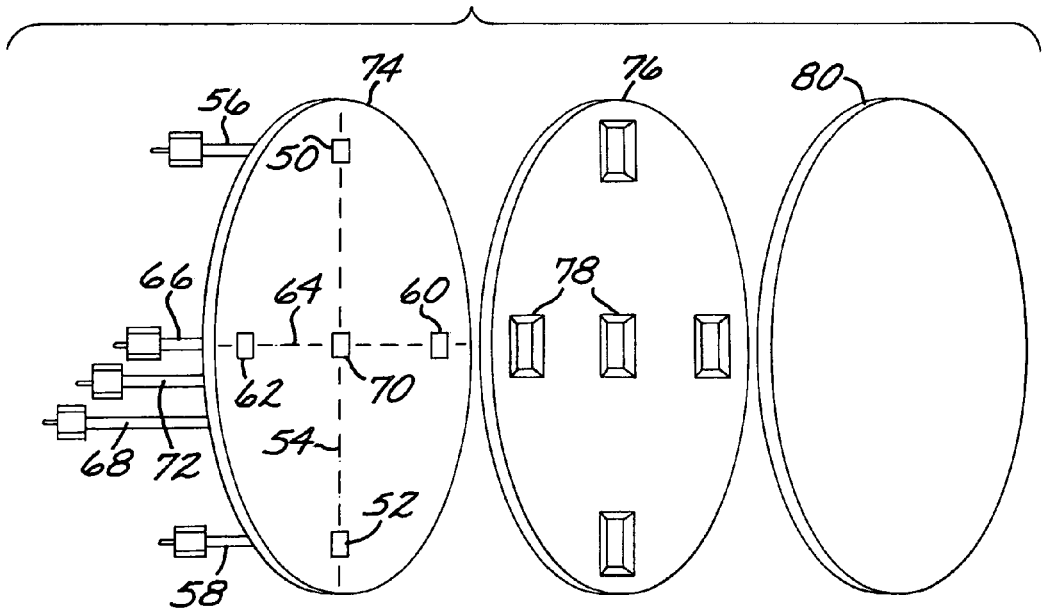

APPARATUS AND METHOD USING WAVEFRONT PHASE MEASUREMENTS TO DETERMINE GEOMETRICAL RELATIONSHIPS

This invention relates to the determination of geometrical relationships using phase measurements such as microwave phase relationships and, more particularly in one embodiment, to aligning a reflector-type microwave transmitter/receiver.

BACKGROUND OF THE INVENTION

In service, a microwave transmitter reflector (also called the main reflector or the antenna) is aimed at a distant location of interest. The microwave transmitter reflector either receives microwave signals from that distant location, or transmits microwave signals toward that distant location. A high-gain microwave transmitter reflector system typically has a dish-type microwave transmitter reflector that is pointed at the distant location for reception and transmission. The pointing is accomplished by mounting the microwave transmitter reflector on a gimbal structure that permits aiming in both the elevation and azimuth orientations. The structures of the microwave transmitter reflector and gimbal are desirably made no heavier than necessary to avoid an overly large gimbal structure.

Reflector-type microwave antenna systems are subject to electromechanical, optical, and/or mechanical misalignments. The result of the misalignments is a mispointing and possible off-axis aberrations imparted to the main microwave transmitted beam or incoming microwave signal. The highest-gain microwave antennas have large dish-type microwave transmitter reflectors, and even slight misalignments can greatly decrease the performance of the antenna system, resulting in the loss of key data or the arrival of less power.

One of the principal sources of misalignment is the tolerances and deformation associated with the mechanical elements of the microwave transmitter reflector. Mechanical tolerances in all parts of the gimbal assembly, such as gear backlash, tilts of relay optics, and bearing wear and tolerances, cause beam misalignment, when the transmitter source is not on the gimbal assembly (as is usually the case to keep the gimbaled weight as low as possible). The amount of the mechanical misalignments varies with the pointing angle of the gimbal, as the weight-of the microwave transmitter reflector shifts. The mechanical misalignment also varies with the service age of the antenna system, since the mechanical wear increases over time. Particularly for microwave systems operating in the higher frequencies, such as high-gigahertz-frequency systems where the wavelength is on the order of millimeters, the deformation and mechanical errors may be a significant portion of a wavelength. In such instances, the mispointing of the microwave transmitter reflector as it is pointed in different directions can result in a significant misalignment and loss of signal or power level. Other sources of misalignment are the mechanical deforming of the reflective elements of the system, such as the microwave transmitter reflector and the microwave mirrors, and pointing errors due to extraneous factors such as gusty wind loadings.

For some microwave systems, such as those using fixed, ground-based high-gain reflector-type antennas, the misalignment may be calibrated so that the pointing of the reflector is corrected as a function of the pointing angle. Other types of errors, such as wind loading, gear backlash, bearing wear, and differential thermal expansion, cannot be corrected through the calibration approach.

In these other cases, alternative approaches, such as using a visible laser aiming system operating in conjunction with the microwave aiming system, may be used. See, for example, U.S. Pat. No. 6,252,558, whose disclosure is incorporated by reference. Such approaches are highly successful for some applications. In others, the use of a visible laser of sufficiently high power raises eye-safety and visibility concerns, and also requires the optical elements to have optical quality surfaces. Additionally, this approach does not address the fundamental problem of beam skew due to asymmetrical incident phase contours.

There is a need for an improved approach to correcting the aiming of a microwave antenna reflector. The present invention fulfills this need, and further provides related advantages.

SUMMARY OF THE INVENTION

The present approach provides an apparatus and a method for determining geometrical relationships using wavefront phase measurements, with the primary interest being antenna systems operating in the microwave wavelength ranges. (As used herein, "microwave" is used to include energy in both what is sometimes considered to be the microwave wavelength range and also the millimeter wavelength range, to avoid any controversy over the precise definition of the ranges.) The approach is applicable in the alignment of antennas such as microwave antennas, and also in other applications such as measuring systems. The use of a relatively small number of sensing points provides sufficient information that geometric relations may be determined. The output data of the present approach may be provided in a form that is amenable to closed-loop control of the system being measured, such as closed-loop control of the pointing of the microwave antenna in that application. The approach does not require the use of or knowledge of pulse amplitudes or pulse shapes.

In accordance with the invention, an apparatus comprises a source that produces a feed beam, and a first pair of sensors operable to sense the wavelength(s) of the feed beam. The sensors include a first sensor positioned to intercept and receive a first portion of the feed beam, wherein the first sensor has a first-sensor output signal; and a second sensor positioned to intercept and receive a second portion of the feed beam and spaced apart from the first sensor along a first-pair axis, wherein the second sensor has a second-sensor output signal. A first phase-comparison device has as an input the first-sensor output signal and the second-sensor output signal, and as an output a first phase comparison of the first-sensor output signal and the second-sensor output signal. A first geometrical calculator has as an input the first phase comparison and as an output a geometrical relationship of the first-pair axis to an other feature. The source is preferably a microwave source, the feed beams are preferably microwave feed beams, and the sensors are preferably microwave sensors. Because the primary interest is in the microwave frequency range, that will be the primary focus of the discussion. However, sets of components in other wavelength ranges such as the optical (i.e., ultraviolet, visible, infrared) wavelength ranges are operable as well.

The geometrical relationship may be an angular relation between the first-pair axis and the other feature, where the other feature may be a physical feature or the microwave feed beam. The geometrical relationship may instead be a distance from the first-pair axis to the other feature. In an application of particular interest, the first microwave sensor and the second microwave sensor are affixed to a microwave transmitter reflector. In the preferred case, the transmitted microwave feed beam is reflected from the microwave transmitter reflector and into free space. A controller may be used to receive as an input the geometrical relationship and to produce as an output a control signal that alters the geometrical relationship. In the case of the aiming of the microwave transmitter reflector, the controller may drive the gimbal motors to correct the pointing responsive to the deformation of the microwave transmitter reflector or gimbal positioning errors as a function of the pointing angle.

The present approach is operable with a single pair of the microwave sensors. More often, however, the apparatus further comprises a second pair of microwave sensors including a third microwave sensor positioned to intercept and receive a third portion of the microwave feed beam, wherein the third microwave sensor has a third-sensor output signal; and a fourth microwave sensor positioned to intercept and receive a fourth portion of the microwave feed beam and spaced apart from the third microwave sensor along a second-pair axis that is not parallel to the first-pair axis, wherein the fourth microwave sensor has a fourth-sensor output signal. In a typical application, the first-pair axis and the second-pair axis intersect, and may be orthogonal to each other. A second phase-comparison device has as an input the third-sensor output signal and the fourth-sensor output signal, and as an output a second phase comparison of the third-sensor output signal and the fourth-sensor output signal. A second geometrical calculator has as an input the second phase comparison and as an output a geometrical relationship of the second-pair axis to the other feature. The use of this approach using two pairs of sensors allows the pointing to be corrected in two angular directions, such as elevation and azimuth for conventional systems. Additional sensors may be added if needed at different positions to resolve angle-ambiguity problems. Other features as discussed herein may be used with this second pair of microwave sensors. As used herein, a discussion of a first pair of sensors and a second pair of sensors does not require that there are four sensors. One element of each pair may be the same sensor. For example, for sensors A, B, and C arranged so that all three sensors are not in a straight line (i.e., are in a triangular pattern), one sensor pair may be sensors A and B, and the second sensor pair may be sensors A and C.

In one convenient approach, all of the microwave sensors are mounted to a common sensor support. Some or all of the phase-comparison devices and the geometrical calculators may also be mounted to the common sensor support as well. This arrangement provides a convenient microwave measurement array that may be affixed in place where needed. For example, it may be affixed to the final microwave transmitter reflector surface.

In the presently preferred application, an apparatus used in the alignment of a microwave transmitter reflector comprises a microwave source that produces a transmitted microwave feed beam, and a first pair and a second pair of microwave sensors as described above. The first pair of microwave sensors are spaced apart along a first-pair axis, and a second pair of microwave sensors are spaced apart along a second-pair axis that is not parallel to the first-pair axis. The first-pair axis and the second-pair axis preferably intersect, most preferably orthogonally. The first and second phase-comparison devices, and first and second geometrical calculators, are provided as well. The four microwave sensors are affixed to a microwave transmitter reflector. The transmitted microwave feed beam is reflected from the microwave transmitter reflector and into free space. An optional controller receives as an input the angular relationships and has as an output a control signal that alters the angular relationships. As discussed above, the four microwave sensors may be mounted to a common support, which in turn is affixed to the microwave transmitter reflector.

The present approach provides an apparatus and method for determining geometric relationships using wavefront phase measurements of a microwave feed beam. No microwave receiver is required at the far location. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 5 is a schematic elevational view of the microwave transmitter reflector and a first embodiment of the phase-measurement structure;

FIG. 6 is a schematic partially exploded perspective view of the microwave transmitter reflector and a second embodiment of the phase-measurement structure;

DETAILED DESCRIPTION OF THE INVENTION

Figure 1:
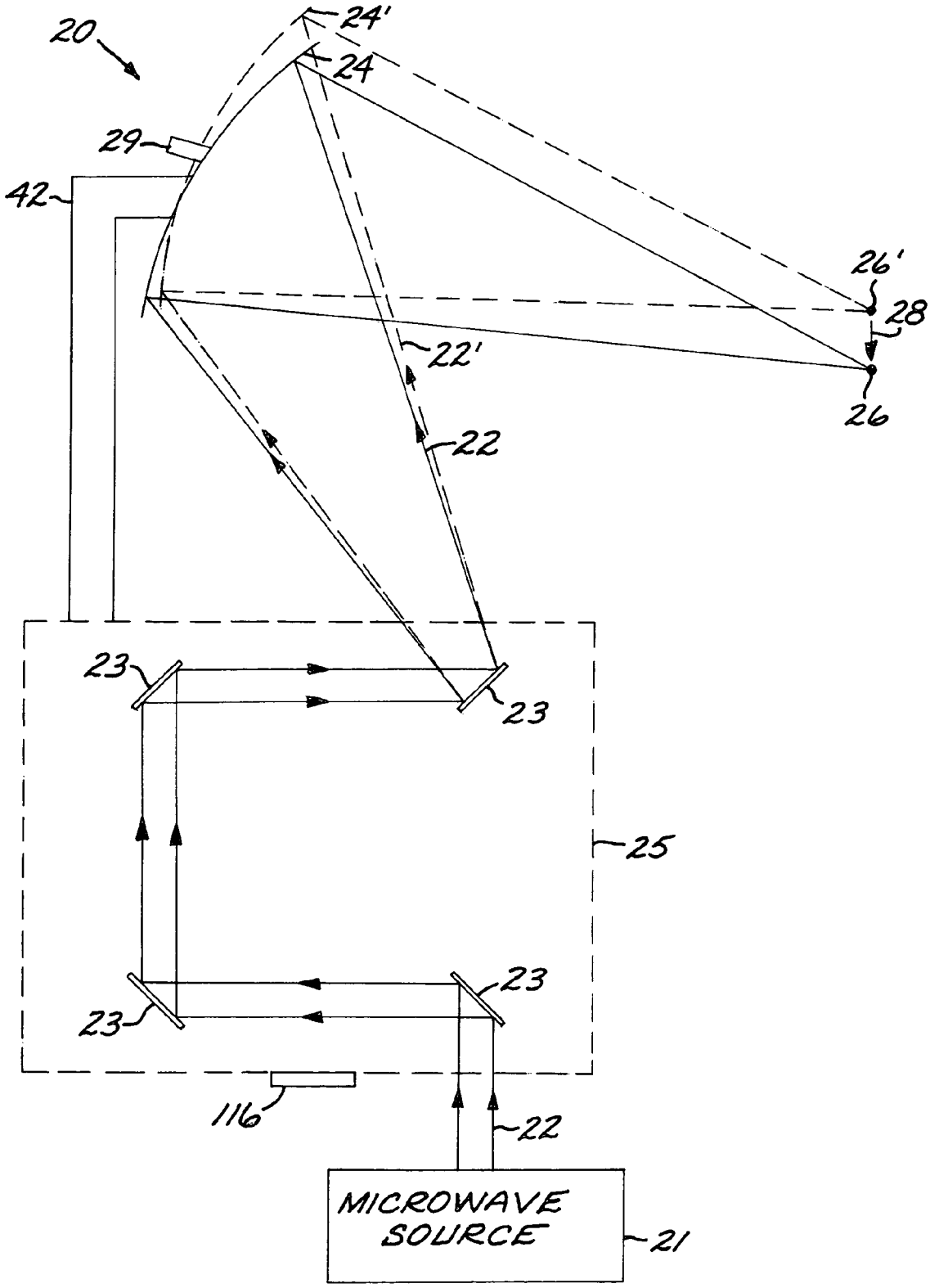
FIG. 1 is a schematic elevational view of a microwave apparatus, illustrating the problem arising when the microwave transmitter reflector deforms.

FIG. 1 depicts a microwave apparatus 20 including a microwave source 21 that transmits a microwave feed beam 22. The microwave feed beam 22 reflects from the relay mirrors 23 of a gimbal structure 25 to a microwave transmitter reflector 24, and thence from the microwave transmitter reflector 24 into and through free space to a distant location 26. A television camera 29 may be provided on the microwave transmitter reflector 24 for visual alignment of the microwave feed beam 22. The microwave transmitter reflector 24 is supported from the gimbal structure by a support arm 42.

Desirably, the microwave transmitter reflector 24 is always pointed at the selected distant location 26 and always retains its ideal shape. However, this idealization is not always realized, due to misalignments in the mechanical structure or deformation of the microwave transmitter reflector 24. In regard to the mechanical misalignments, if for any reason the microwave feed beam 22 of the microwave source 21 is not perfectly aligned with the axis of rotation of the gimbal structure 25, any rotation of the gimbal structure 25 about the axis of rotation produces a shift in the angle that the microwave feed beam 22 hits the microwave transmitter reflector 24 (and which altered angle may be depicted as microwave transmitter reflector 24'), producing an offset in the beam-pointing direction and thence an offset in the distant location 26 to a different distant location 26'. This loss of perfect alignment may be due to any of a number of mechanical causes, such as unintended movement of the mirrors 23, backlash in the bearings of the gimbal structure 25, mechanical tolerances in any of the bearings or mirror mounts, and the like. In regard to deformation, in practice the microwave transmitter reflector 24 may deform from its ideal shape to that of the microwave transmitter reflector 24', with the result that the microwave feed beam 22' is reflected by the microwave transmitter reflector 24' to the different distant location 26'. The deformation of the microwave transmitter reflector 24 might be caused, for example, by the natural slight mechanical bending of the structural elements as the microwave transmitter reflector 24 is re-pointed by a pivoting movement on its gimbals, or by gusty wind loadings.

For a large-diameter, high-gain microwave transmitter reflector 24, 24' that is mispointed due to mechanical reasons or deformation, the distant location 26' may be displaced from the intended distant location 26 by such a large distance that there is such a significant loss of signal strength at the intended distant location 26 that the functionality of the system is substantially degraded. If the angular displacement between the distant locations 26 and 26' is known, then the microwave transmitter reflector 24 may be re-pointed to take into account the deformation of the microwave transmitter reflector 24, which in the illustrated case would involve a small clockwise rotation 28 of the microwave transmitter reflector 24 on its gimbal structure 25 to bring the distant location 26' into coincidence with the intended distant location 26. (U.S. Pat. No. 6,252,558 describes this type of microwave system using a microwave source reflected from the microwave transmitter reflector, but with a different approach to improving the pointing accuracy than will be discussed herein.)

Figure 2:
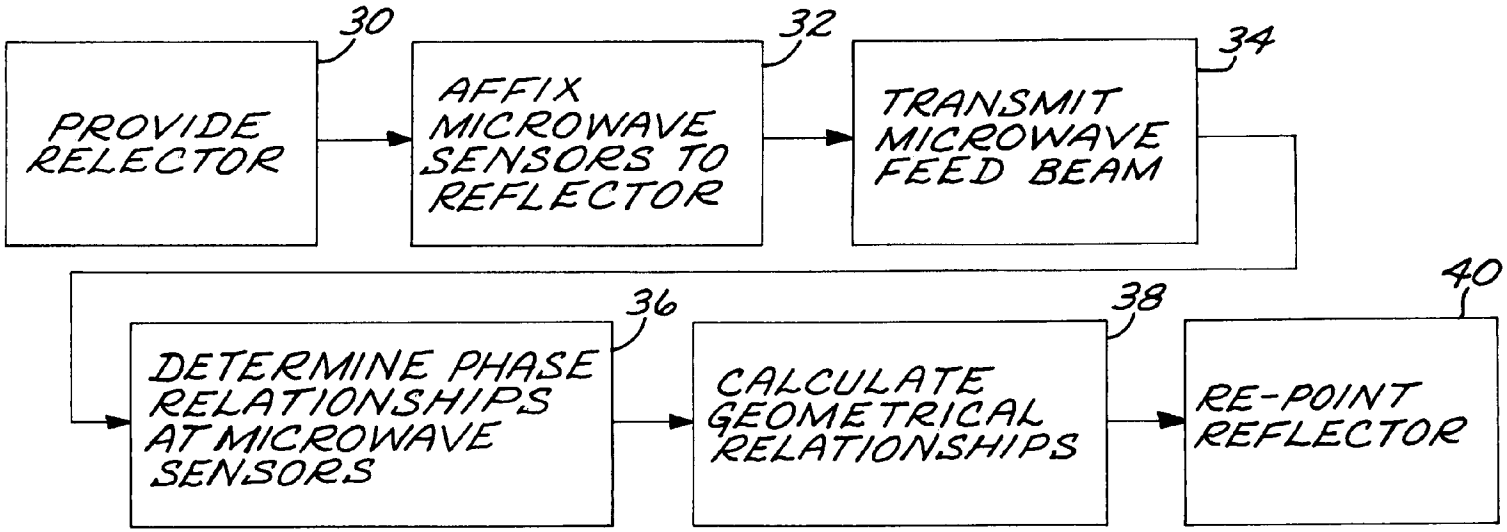
FIG. 2 is a block flow diagram of a method for aligning the microwave transmitter reflector.
Figure 4:
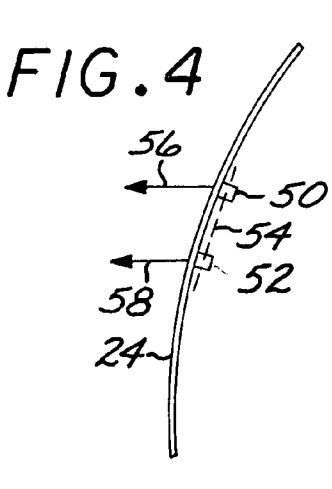
FIG. 4 is a schematic elevational view of a second approach for the placement of a pair of microwave sensors on the microwave transmitter reflector.
Figure 3:
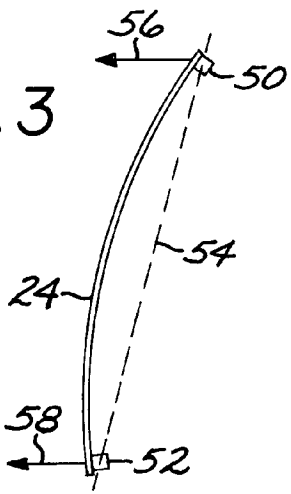
FIG. 3 is a schematic elevational view of a first approach for the placement of a pair of microwave sensors on the microwave transmitter reflector.

FIG. 2 depicts an approach for re-pointing the microwave transmitter reflector 24 using microwave wavefront phase measurements. The microwave transmitter reflector 24 is provided, step 30. Microwave sensors are affixed to the microwave transmitter reflector 24, step 32. FIGS. 3–4 illustrate two approaches to affixing a pair of microwave sensors 50, 52 to the microwave transmitter reflector 24, in each case with the microwave sensors 50, 52 spaced apart from each other along a first-pair axis 54. In the approach of FIG. 3, the microwave sensors 50, 52 are spaced apart by essentially the entire dish diameter of the microwave transmitter reflector 24. In the approach of FIG. 4, the microwave sensors 50, 52 are spaced much closer together, and may be mounted to a common substrate as will be discussed subsequently. The first microwave sensor 50 is positioned to intercept and receive a first portion of the microwave feed beam 22, and the second microwave sensor 52 is positioned to intercept and receive a second portion of the microwave feed beam 22. The microwave sensors 50, 52 are small in size, and only intercept a small portion of the energy of the microwave feed beam 22 so that there is little loss of signal strength. The microwave sensors 50, 52 have respective output signals 56, 58, which are microwave amplitude as a function of time for the respective microwave sensors 50, 52.

FIGS. 5 and 6 depict two illustrative structural embodiments. In the embodiment of FIG. 5, each of the microwave sensors 50, 52 is an open-ended waveguide probe.

In the embodiment of FIG. 6, each of the microwave sensors 50, 52 is a microstrip patch antenna. The embodiments of FIGS. 3, 4, and 5 all use the single pair of microwave sensors 50, 52 arranged along the first-pair axis 54. This structure provides information regarding the geometric relation of the microwave transmitter reflector 24 and the microwave feed beam 22, in a single dimension relative to the first-pair axis 54. To obtain the geometric relation in two dimensions, as illustrated in FIG. 6, a second pair of microwave sensors, including a third microwave sensor 60 and a fourth microwave 62, are spaced apart along a second-pair axis 64 that is not parallel to the first-pair axis 54. In the illustration the first-pair axis 54 and the second-pair axis 64 intersect, and preferably are orthogonal. The microwave sensors 60, 62 have respective outputs 66, 68. Optionally, a fifth microwave sensor 70 having an output 72 is positioned at the location where the first-pair axis 54 and the second-pair axis 64 intersect. The sensor 70 and additional sensors can be used to resolve angular ambiguity, when a sensor moves over 180 degrees in phase.

The first pair and second pair of microwave sensors may utilize four sensors, three sensors, or five or more sensors. Four sensors may form two pairs, where there is no sensor common between the two pairs. Three sensors may form two pairs, where one sensor is shared between the two pairs; for example, sensors A, B, and C may form two pairs, with sensors A and B being one pair and sensors A and C being a second pair. Five or more sensors may form a structure with two pairs of sensors, by combining additional sensors for more data points with each of the pairs.

In the embodiment of FIG. 6, the microwave sensors 50, 52, 60, 62, and 70 are all mounted to a single common sensor support 74, which in turn is mounted to the face of the microwave transmitter reflector 24. (The common sensor support 74 may be a monolithic semiconductor chip as will be discussed in relation to FIG. 10.) A metallic plate 76 with a respective pyramidal slot 78 corresponding to each of the microwave sensors 50, 52, 60, 62, and 70 overlies the common sensor support 74. A transmission plate 80, made of a radio-frequency-reflective material, overlies the metallic plate 76 to provide bulk attenuation.

Referring back to FIG. 2, the microwave feed beam 22 is transmitted by the microwave source 21 to reflect from the microwave transmitter reflector 24, as shown in FIG. 1, step 34. The microwave output signals 56, 58, 66, 68, and 72 are used to determine the phase relationships at the microwave sensors 50, 52, 60, 62, and 70, step 36.

Figure 7:
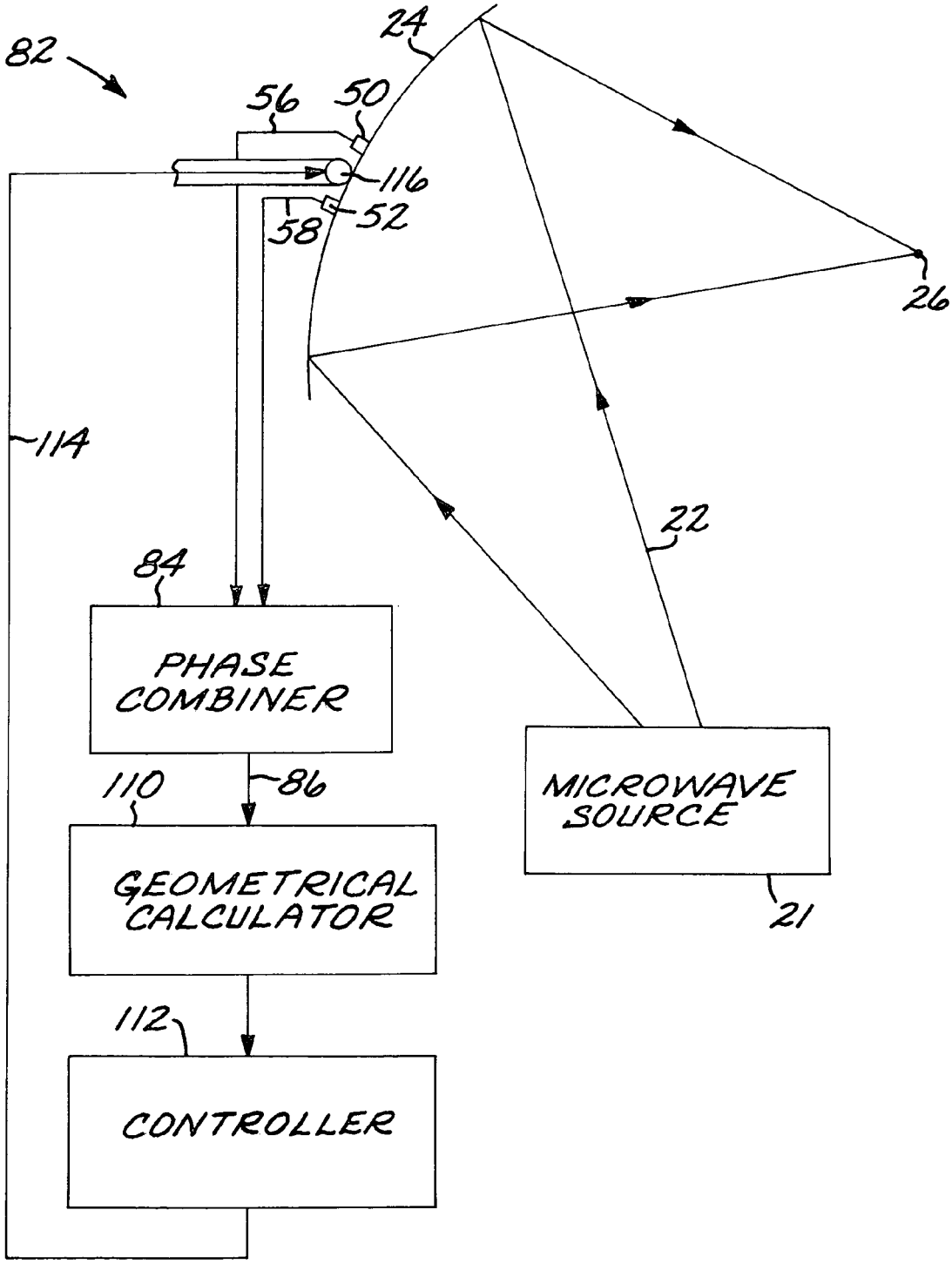
FIG. 7 is a schematic view of a microwave transmission system according to the present approach.

FIG. 7 illustrates the structural and analytical components of the microwave system 82, for the case of only the first pair of microwave sensors 50, 52, and where the gimbal structure 25 shown in FIG. 1 is omitted for clarity but is normally present. (The approach is similar for the second pair of microwave sensors 60, 62 and is normally present, but is omitted here to avoid confusion in the illustration.) To accomplish the determination of the phase relationships, step 36, the outputs 56, 58 are provided to a phase combiner 84 (which also may be described as a phase-comparison device or a phase-difference detector). The relative phase at the microwave sensors 50, 52 (and 60, 62, where present) is converted to DC signals 86 or other useful electrical form carrying relative phase information by combining, utilizing branchline couplers, hybrid-Tee junctions, or other operable combining technique.

Figure 8:
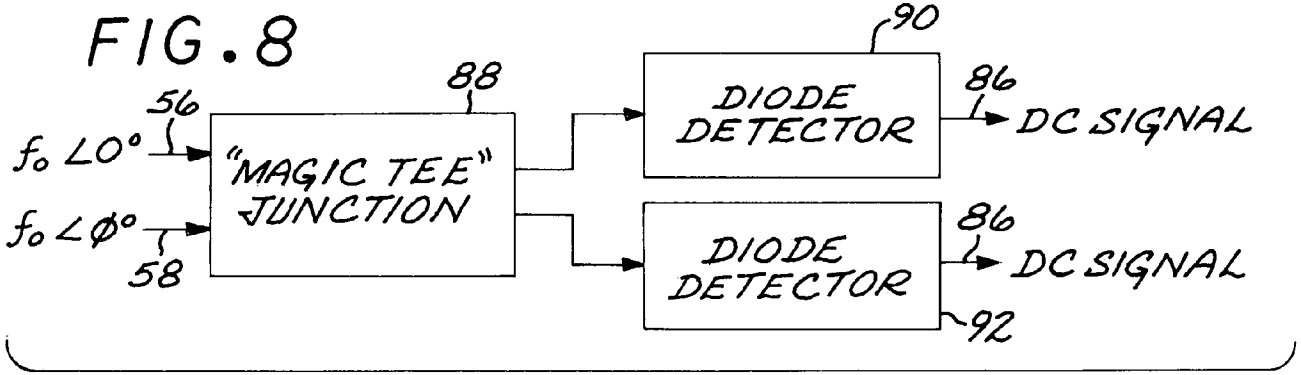
FIG. 8 is a schematic diagram of a first microwave phase discrimination technique.
Figure 9:
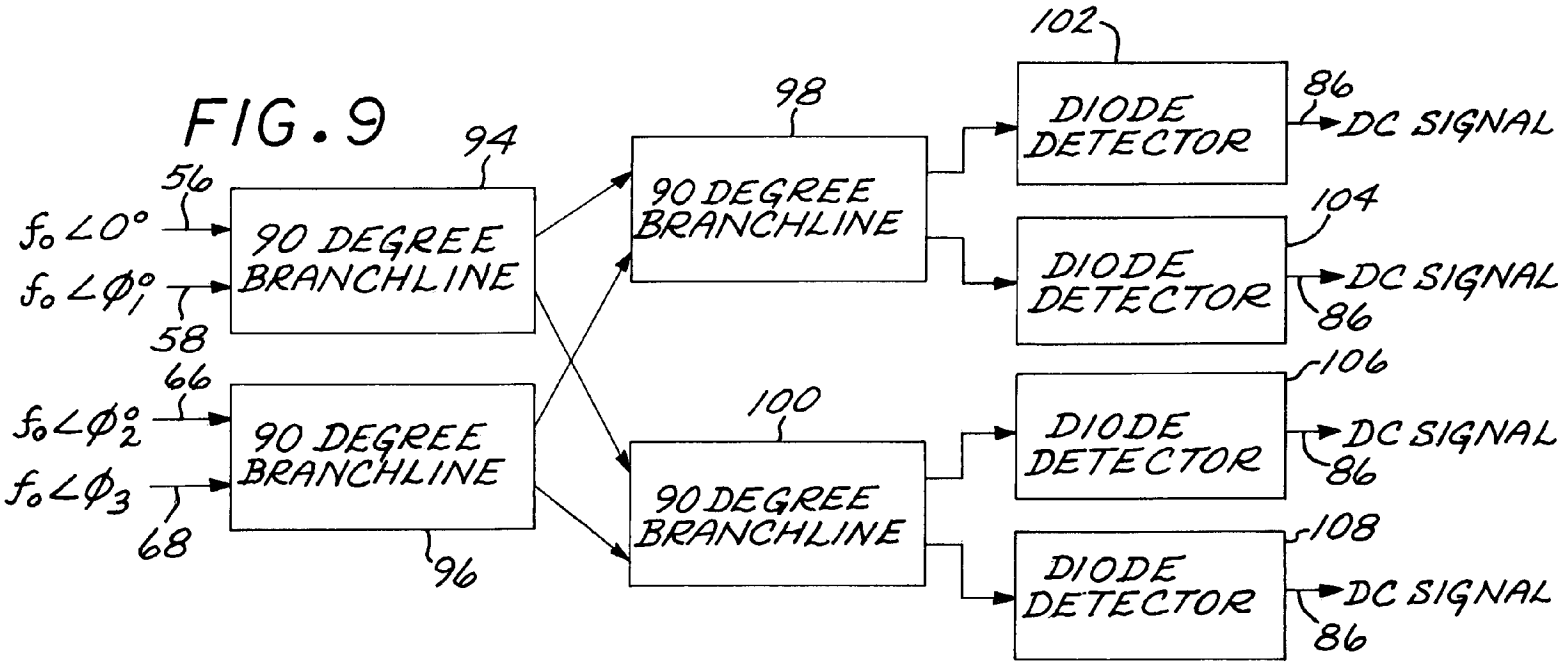
FIG. 9 is a schematic diagram of a second microwave phase discrimination technique.

Phase combiners/detectors 84 are known in the art, see for example Kai Chang, ed., Handbook of Microwave and Optical Components, Vol. 1, page 153, John Wiley & Sons., Inc., 1989; and Merrill I. Skolnik, ed., Radar Handbook, second edition, pages 3/36–3/37, McGraw Hill, 1990. FIGS. 8–9 illustrate by way of example two such approaches operable in the phase combiner 84. In FIG. 8, the outputs 56, 58 are provided to a magic-Tee junction, whose outputs are provided to diode detectors 90, 92. The output of the diode detectors are DC signals 86. In FIG. 9, illustrated for four sensor outputs 56, 58, 66, and 68, the outputs are provided to a first pair of 90-degree branchline couplers 94 and 96, whose outputs are cross-provided as inputs to a second pair of 90-degree branchline couplers 98, 100. The outputs of the second stage of 90-degree branchline couplers 98, 100 are provided to diode detectors 102, 104, 106, and 108, whose outputs are the DC signals 86.

Figure 10:
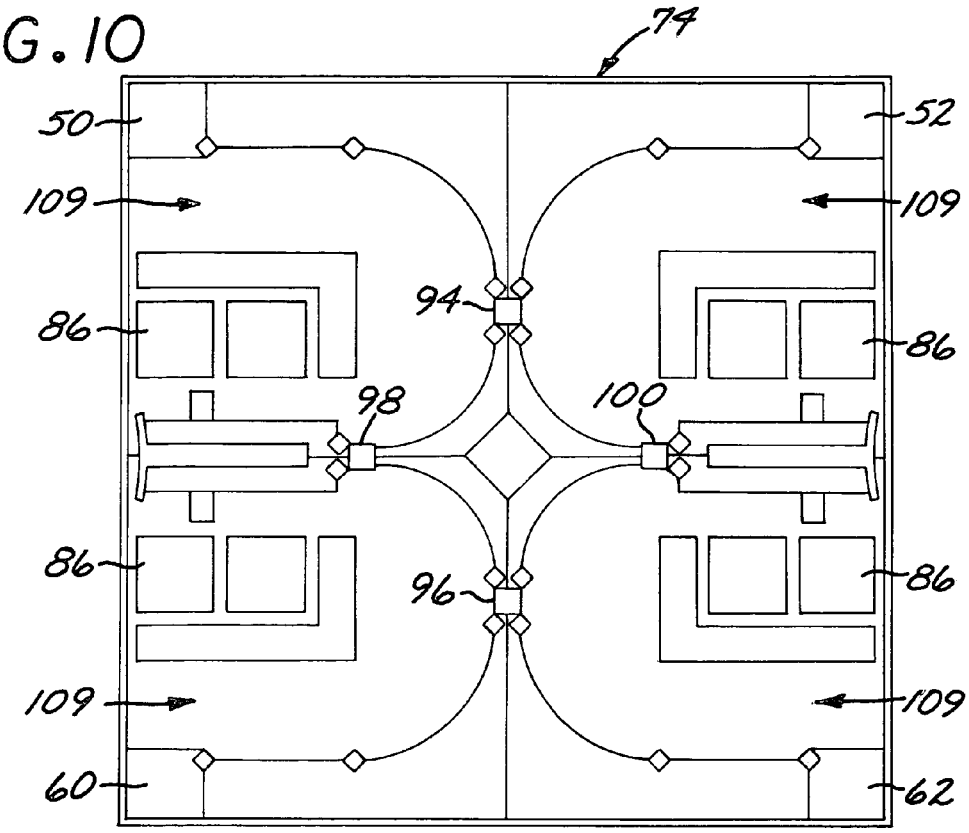
FIG. 10 is a plan view of a monolithic semiconductor chip incorporating the microwave sensors and phase comparison devices.

The microwave sensors 50, 52, 60, and 62, and the phase combiner 84 such as illustrated in FIG. 9, may be produced on the single common sensor support 74, as shown in FIGS. 4 and 6, and in greater detail in FIG. 10, wherein the common sensor support is a monolithic semiconductor chip. The elements discussed in relation to FIG. 9 are illustrated, and the prior discussion of FIG. 9 is incorporated. Each of the diode detectors 102, 104, 106, and 108 is mounted to one of the pads 109 (but are omitted from FIG. 10 so as not to obscure the underlying structure). The entire structure of the microwave patch sensors 50, 52, 60, 62, the branchline couplers 94, 96, 98, 100, and the diodes 102, 104, 106, and 108 are mounted to the single common sensor support 74. For a millimeter-wave range microwave system 82, such a common sensor support 74 is a square about 0.5 inch on a side. As shown in FIG. 9, the four-sensors 50, 52, 60, and 62 are not analyzed as two orthogonal pairs 50, 52 and 60, 62 in the manner described in relation to FIG. 6 and should not be compared in that manner. The similarity is that the sensors in FIGS. 6 and 10 are all mounted to a common sensor support in each case.

The outputs of the phase combiner 84 of FIG. 7, determined in step 36 of FIG. 2, are used to calculate geometrical relationships, step 38 of FIG. 2, in a geometrical calculator 110 of FIG. 7. The geometrical calculator 110 calculates the geometric relation between the microwave phase relationships expressed in the DC signals 86 and some other feature, either a physical feature or the microwave feed beam 22. The geometrical calculator 110 may be implemented in either a hardware or a software computer calculator.

The structure and function of the geometrical calculator 110 are specific to the particular application. In the case of the alignment and pointing of the microwave transmitter reflector 24, the expected angular beam slew θ in the far field at the distant location 26 may be calculated as a function of the microwave wavelength λ, the spacing of the microwave sensors d (see FIG. 5 for example), and the incident phase difference α as $$\alpha = k_o d \sin \theta$$

Thus, to monitor beam scans as great as θ=+/−2/3 degree, d is 21.49λ. This is a small spacing in a microwave transmitter reflector which may be 1000λ across. The approach of FIGS. 4, 6, and 10, using a set of microwave sensors mounted on a common sensor support 74, is therefore quite feasible.

Optionally, the calculated geometrical relationship results of the geometrical calculator 110 in step 38 may be used to re-point the microwave transmitter reflector 24, step 40 of FIG. 2. This re-pointing of the microwave transmitter reflector 24 is typically accomplished with a controller 112 that receives as an input the geometrical relationship from the geometrical calculator 110 and has as an output a control signal 114 that alters the geometrical relationship in a feedback manner. In the embodiment of FIG. 7, the control signal 114 is provided to a gimbal drive 116 of the gimbal structure (element 25 in FIG. 1) upon which the microwave transmitter reflector 24 is mounted. Equivalently for the present purposes, the effective position of the microwave source 21 may be changed, either by moving the source 21 itself or redirecting the microwave feed beam 22 with mirror changes. Additionally or instead, the control signal 114, in the form of an angular difference between the locations 26 and 26', could be used to electronically move an aim point (i.e., cross hairs) of the television camera 29 to indicate where the microwave feed beam 22 is actually pointing (that is, to location 26' rather than to location 26.)

Figure 11:
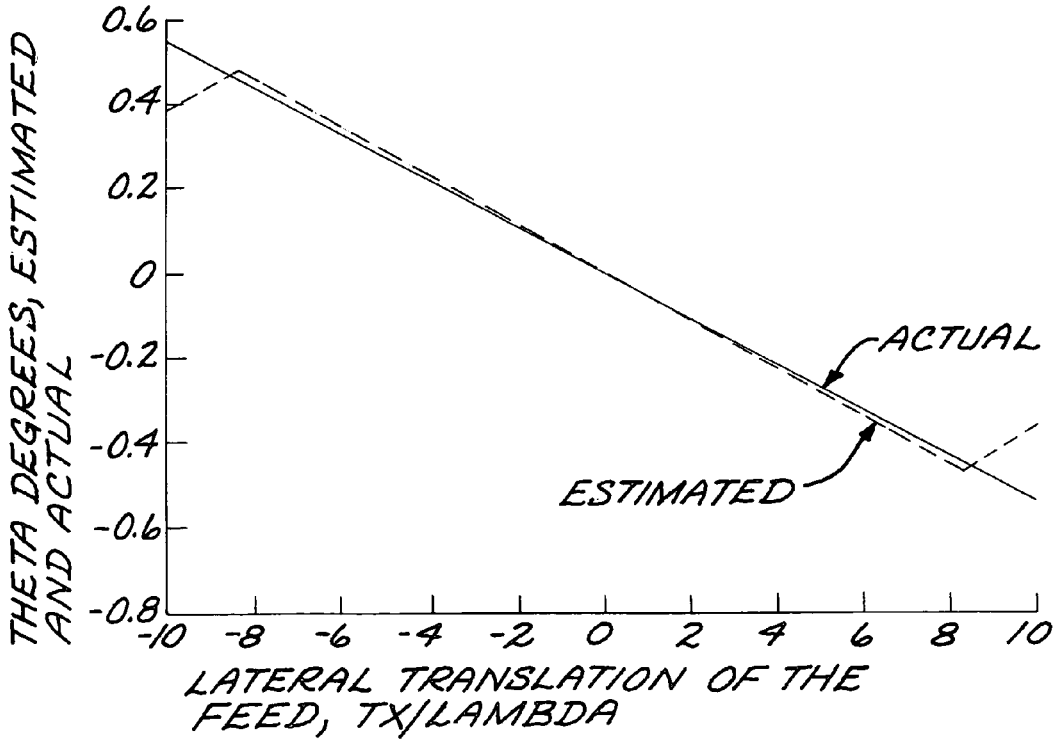
FIG. 11 is a graph of angle theta as a function of lateral translation of the microwave feed, showing estimated and actual errors.

The application of the present approach used in pointing the microwave transmitter reflector 24 has been reduced to practice as a prototype and tested. In an example, a large parabolic microwave transmitter reflector 24 has a focal length of 1000λ and a diameter of 1000λ. It is fed by a microwave source 21 that produces a microwave feed beam 22 having a Gaussian beam feed profile with an edge taper of approximately 10 dB across the aperture. The microwave feed beam 22 is displaced by 5λ perpendicular to the axis of symmetry of the parabolic microwave transmitter reflector 24. In a two-dimensional analysis, two samples were taken with a separation of 30λ, and a beam skew was predicted as described above. A wide range of feed displacements and the resulting predictions are shown in FIG. 11. The predicted and actual estimation errors are very close.

Thus, once the phase difference of a wavefront has been measured by the microwave sensors, the wavefront alignment errors may be corrected. This correction is accomplished using only measurements at the origin of the transmitted microwave beam, specifically at the microwave transmitter reflector 24 and/or the microwave source 21. This re-pointing may be automated with the feedback system as illustrated in FIG. 7.

It is convenient in most cases to make the phase-difference measurements at the microwave transmitter reflector 24. Equivalently, however, these phase-difference measurements may be made at any point along the microwave feed beam 22 within the microwave system 82 or along the free-space microwave beam as it propagates between the microwave transmitter reflector 24 and the distant location 26. The results may then be sent back to the microwave system 82 to re-point the microwave transmitter reflector 24 or the microwave source 21 as needed.

Figure 12:
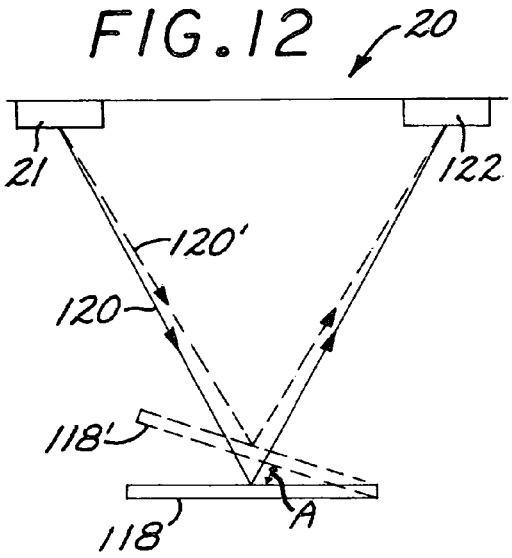
FIG. 12 is a schematic drawing illustrating the present approach applied to the measurement of the angular relation of a remote surface.

The present approach based on microwave wavefront phase-measurement differences may also be used to determine other types of geometrical relationships. As shown in FIG. 12, an angle A between two targets 118, 118' produces a relative phase change in two microwave beams 120, 120' transmitted from the microwave source 21, reflected from the targets 118, 118', and received at a microwave sensor 122. The microwave sensor 122 has a structure like that described above, which is incorporated here, utilizing one or more pairs of individual microwave sensors separated along respective pair axes.

Figure 13:
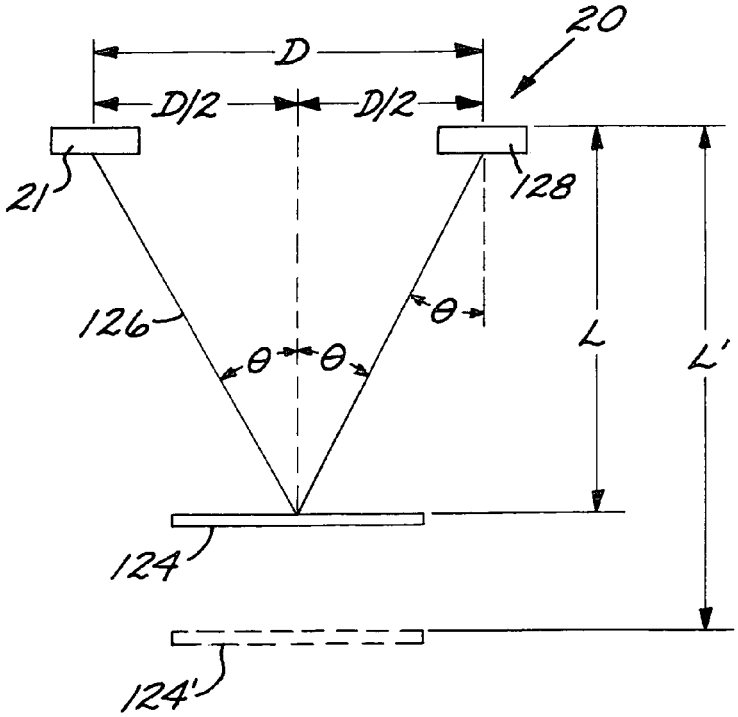
FIG. 13 is a schematic drawing illustrating the present approach applied to the measurement of the distance and movement of a remote surface.

Similarly, as illustrated in FIG. 13, a distance L from a microwave apparatus 20, where the microwave source 21 and a microwave sensor 128, are each a distance D/2 from a reference axis, to a target 124 is determined as L= D/2 tan θ. The angle θ is measured by the approach discussed earlier from the phase difference of the microwave beam 126 that is transmitted by the microwave source 21, reflects from the target 126, and is received by the microwave sensor 128. If the target is moving, its velocity toward or away from the microwave apparatus 20 is determined by making two microwave distance measurements of the target, a first measurement of the target 124 at $t_O$ and a second measurement of the target indicated as target 124' at $t_1$ (the values of the phase differences, and thence the angles, will change between the two measurements). The velocity of the target is then calculated as $(L'-L)(/t_1-t_O)$.

Figure 14:
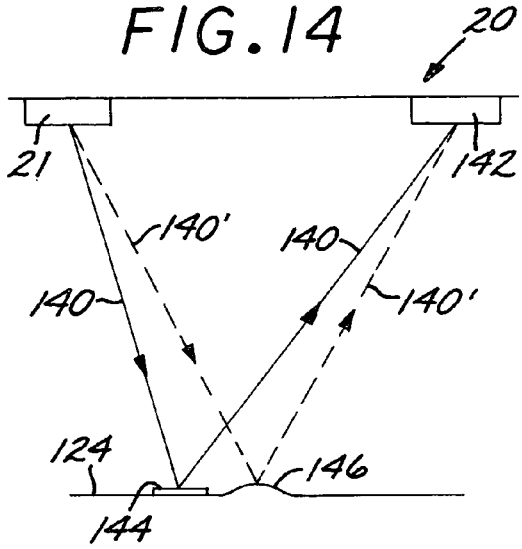
FIG. 14 is a schematic drawing illustrating the present approach with the addition of a quarter-wave plate polarization rotater.

FIG. 14 illustrates an application of the present approach that makes use of polarization to gather information about the nature of the target 124. A polarized microwave beam 140, 140' from the microwave source 21 is reflected from the target 124 to a microwave sensor 142. A microwave wave-plate polarization rotater 144 is positioned overlying a portion of the surface of the target 124, while another portion 146 of the surface of the target 124 has no such microwave wave-plate polarization rotater 144. The microwave beam 140 that reflects from the microwave wave-plate polarization rotater 144 has its polarization rotated by some amount, typically 90 degrees. For example, the microwave beam 140 that is originally vertically polarized would be rotated to a horizontal polarization. The microwave sensor 142 is set to receive and detect only one polarization, the horizontal polarization in the example. The microwave sensor 142 will therefore detect only the portion of the microwave beam 140 that is reflected from the microwave wave-plate polarization rotater 144, and will not detect the portion of the microwave beam 140' that is reflected from the portion 146 of the surface of the target 124 that does not have the microwave wave-plate polarization rotater 144.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An apparatus comprising:

a source that produces a feed beam;

a first pair of sensors including a first sensor positioned to intercept and receive a first portion of the feed beam, wherein the first sensor has a first-sensor output signal, and a second sensor positioned to intercept and receive a second portion of the feed beam and spaced apart from the first sensor along a first-pair axis, wherein the second sensor has a second-sensor output signal;

a first phase-comparison device having as an input the first-sensor output signal and the second-sensor output signal, and as an output a first phase comparison of the first-sensor output signal and the second-sensor output signal; and a first geometrical calculator having as an input the first phase comparison and as an output a geometrical relationship of the first-pair axis to an other feature.

2. The apparatus of claim 1, wherein the source is a microwave source, the feed beam is a microwave feed beam, and the sensors are microwave sensors.

3. An apparatus comprising:

a microwave source that produces a microwave feed beam;

a first pair of microwave sensors including a first microwave sensor positioned to intercept and receive a first portion of the microwave feed beam, wherein the first microwave sensor has a first-sensor output signal, and a second microwave sensor positioned to intercept and receive a second portion of the microwave feed beam and spaced apart from the first microwave sensor along a first-pair axis, wherein the second microwave sensor has a second-sensor output signal;

a first phase-comparison device having as an input the first-sensor output signal and the second-sensor output signal, and as an output a first phase comparison of the first-sensor output signal and the second-sensor output signal; and a first geometrical calculator having as an input the first phase comparison and as an output a geometrical relationship of the first-pair axis to an other feature.

4. The apparatus of claim 3, wherein the geometrical relationship is a distance from the first-pair axis to the other feature.

5. The apparatus of claim 3, wherein the geometrical relationship is an angular relation between the first-pair axis and the other feature.

6. The apparatus of claim 3, wherein the first microwave sensor and the second microwave sensor are mounted to a common sensor support.

7. The apparatus of claim 3, wherein the first microwave sensor and the second microwave sensor are affixed to a microwave transmitter reflector.

8. The apparatus of claim 7, wherein the first microwave sensor and the second microwave sensor are mounted to a common sensor support, and wherein the common sensor support is mounted to the microwave transmitter reflector.

9. The apparatus of claim 3, wherein the first microwave sensor and the second microwave sensor are affixed to a microwave transmitter reflector, and wherein the transmitted microwave feed beam is reflected from the microwave transmitter reflector and into free space.

10. The apparatus of claim 3, further including a controller that receives as an input the geometrical relationship and has as an output a control signal that alters the geometrical relationship.

11. The apparatus of claim 3, wherein the other feature is the microwave feed beam.

12. The apparatus of claim 3, wherein the apparatus further includes a second pair of microwave sensors including a third microwave sensor positioned to intercept and receive a third portion of the microwave feed beam, wherein the third microwave sensor has a third-sensor output signal, and a fourth microwave sensor positioned to intercept and receive a fourth portion of the microwave feed beam and spaced apart from the third microwave sensor along a second-pair axis that is not parallel to the first-pair axis, wherein the fourth microwave sensor has a fourth-sensor output signal, a second phase-comparison device having as an input the third-sensor output signal and the fourth-sensor output signal, and as an output a second phase comparison of the third-sensor output signal and the fourth-sensor output signal, and a second geometrical calculator having as an input the second phase comparison and as an output a geometrical relationship of the second-pair axis to the other feature.

13. The apparatus of claim 12, wherein the first-pair axis and the second-pair axis intersect.

14. The apparatus of claim 12, wherein the first-pair axis and the second-pair axis intersect and are orthogonal to each other.

15. The apparatus of claim 12, wherein the first microwave sensor, the second microwave sensor, the third microwave sensor, and the fourth microwave sensor are mounted to a common sensor support.

16. An apparatus comprising:

a microwave source that produces a transmitted microwave feed beam;

a first pair of microwave sensors including a first microwave sensor positioned to intercept and receive a first portion of the transmitted microwave feed beam, wherein the first microwave sensor has a first-sensor output signal, and a second microwave sensor positioned to intercept and receive a second portion of the transmitted microwave feed beam and spaced apart from the first microwave sensor along a first-pair axis, wherein the second microwave sensor has a second-sensor output signal;

a first phase-comparison device having as an input the first-sensor output signal and the second-sensor output signal, and as an output a first phase comparison of the first-sensor output signal and the second-sensor output signal;

a first geometrical calculator having as an input the first phase comparison and as an output an angular relationship of the first-pair axis to the transmitted microwave feed beam;

a second pair of microwave sensors including a third microwave sensor positioned to intercept and receive a third portion of the transmitted microwave feed beam, wherein the third microwave sensor has a third-sensor output signal, and a fourth microwave sensor positioned to intercept and receive a fourth portion of the transmitted microwave feed beam and spaced apart from the third microwave sensor along a second-pair axis that is not parallel to the first-pair axis, wherein the fourth microwave sensor has a fourth-sensor output signal;

a second phase-comparison device having as an input the third-sensor output signal and the fourth-sensor output signal, and as an output a second phase comparison of the third-sensor output signal and the fourth-sensor output signal;

a second geometrical calculator having as an input the second phase comparison and as an output an angular relationship of the second-pair axis to the transmitted microwave feed beam; and a microwave transmitter reflector to which the first microwave sensor, the second microwave sensor, the third microwave sensor, and the fourth microwave sensor are affixed, wherein the transmitted microwave feed beam is reflected from the microwave transmitter reflector and into free space.

17. The apparatus of claim 16, further including a controller that receives as an input the angular relationships and has as an output a control signal that alters the angular relationships.

18. An apparatus comprising:

a source that produces a microwave feed beam;

at least two microwave sensors, wherein each microwave sensor is positioned to intercept and receive a portion of the microwave feed beam, and wherein each microwave sensor has a sensor output signal, and a phase-comparison device having as an input the sensor output signals, and as an output a phase comparison of the output signals; and a geometrical calculator having as an input the phase comparison and as an output a geometrical relationship of the microwave sensors.

19. The apparatus of claim 18, wherein all of the microwave sensors are mounted to a common sensor support.

20. The apparatus of claim 18, further including a controller that receives as an input the geometrical relationships and has as an output a control signal that alters the geometrical relationships.

* * * * *